United States Patent [19]

Nakata et al.

[11] 4,286,134

[45] Aug. 25, 1981

[54] TEMPERATURE MEASURING ARRANGEMENTS FOR MICROWAVE OVENS

[75] Inventors: Takeshi Nakata; Takashi Watanabe; Kiyoshi Harada, all of Otsu, Japan

[73] Assignee: Sanyo Electric Co., Ltd., Osaka, Japan

[21] Appl. No.: 55,759

[22] Filed: Jul. 9, 1979

[30] Foreign Application Priority Data

Jul. 13, 1978 [JP] Japan ..... 53-97531[U]

[51] Int. Cl.[3] ..... H05B 6/68

[52] U.S. Cl. ..... 219/10.55 B; 73/355 R

[58] Field of Search ..... 219/10.55 F, 10.55 B, 219/10.55 R, 10.55 M; 73/355 R, 355 EM

[56] References Cited

U.S. PATENT DOCUMENTS

| | | | |
|---|---|---|---|
| 4,049,938 | 9/1977 | Ueno | 73/355 EM X |
| 4,106,340 | 8/1978 | Hamid | 73/755 R |
| 4,191,876 | 3/1980 | Ohkubo et al. | 219/10.55 B |
| 4,196,332 | 4/1980 | MacKay et al. | 219/10.55 B |

FOREIGN PATENT DOCUMENTS

| | | | |
|---|---|---|---|
| 52-62746 | 5/1977 | Japan | 219/10.55 B |

OTHER PUBLICATIONS

IBM Tech. Disc. Bull., vol. 22, No. 3, Aug. 1979, pp. 1262–1264.

*Primary Examiner*—Arthur T. Grimley
*Attorney, Agent, or Firm*—Darby & Darby

[57] ABSTRACT

An electronic oven equipped with an infrared detector element capable of detecting the temperature of food to be heated in a non-contact manner, in which a reflector converges the infrared rays from the heat in the oven cooking cavity onto the detector element, the reflector being pivotably mounted to cover a plate which has an inlet port to admit the converged rays from the reflector.

16 Claims, 7 Drawing Figures

TEMPERATURE MEASURING ARRANGEMENTS FOR MICROWAVE OVENS

BACKGROUND OF THE INVENTION

In a conventional electronic oven, formed in the upper wall of the cavity is an opening for directing infrared rays radiated from food heated in the cavity to the infrared detector element disposed above the cavity upper wall. However, an atmosphere containing a pollutant such as vapor and oil drops derived from the food heated in the cavity also passes through this opening. This presents a problem in that the infrared converging means, the infrared detector element or the like disposed above the opening are easily contaminated by such a pollutant.

In order to eliminate such problem, following proposals have been made:

(1) To bring an infrared ray permeable filter in close contact with said opening; and (2) To slide a shutter for closing said opening during the time the temperature measurement operation is not performed.

Apparatus of the type (1) above-mentioned is economical and highly reliable because of the absence of mechanical movements required therein, but the filter should be cleansed often according to frequency of use, which is very troublesome.

In apparatus of the type (2) above-mentioned, vapor and oil drops, etc. stick to the space between the opening and the shutter and become something like adhesives, so that a considerable force is required for sliding the shutter across the opening.

OBJECTS OF THE INVENTION

In view of the foregoing, it is an object of the present invention to provide an electronic oven equipped with an infrared detector element for detecting the temperature of food to be heated in a non-contacting manner, in which an infrared converging means is adapted to be located at such a position as to reflect and converge infrared rays onto the infrared detector element when the temperature measurement operation is performed, and adapted to come in contact with a contact plate disposed in front of the infrared detector element when the temperature measurement operation is not performed, so that the reflective convergent surface of the infrared converging means is applied to the contact plate, simultaneously with that the infrared entrance port formed in the contact plate is covered, thereby to prevent the infrared detector element and the reflective convergent surface of the infrared converging means from being contaminated by an atmosphere containing a pollutant such as vapor and oil drops derived from heated food.

It is another object of the present invention to provide an electronic oven in which the infrared detector element is housed in a case having an infrared entrance port therein, thereby to further prevent contamination of the infrared detector element.

It is a further object of the present invention to provide an electronic oven in which the infrared converging means is rotatably supported by a supporting means comprising a supporting shaft, thereby to permit the infrared converging means to be moved by a small force with little friction.

It is still another object of the present invention to provide an electronic oven in which a distance is provided between the lower end of the contact plate in front of the infrared detector element and the periphery of the opening formed in the mounting wall to which the contact plate is mounted. This eliminates a problem that, when the temperature measurement operation is not made, a pollutant attaches to the space between the periphery of the reflective convergent surface of the infrared converging means and the front surface of the contact plate, and such pollutant becomes so sticky that separation of the periphery of the reflective convergent surface from the contact plate becomes difficult.

It is a still further object of the present invention to provide an electronic oven in which the construction of the infrared converging means is simplified in such a way that a concave mirror is attached to one side of the supporting plate, the upper portion of which is rotatably supported by the supporting shaft.

It is a still further object of the present invention to provide an electronic oven in which the construction of a moving means for moving the infrared converging means is simplified in such a way that said moving means is formed by an electromagnet, the movable portion of which is connected to the upper end of the supporting plate of the infrared converging means.

It is a still further object of the present invention to provide an electronic oven in which a stopper is disposed for determining the position of the infrared converging means at the time the moving means of the infrared converging means is operated, so as to efficiently converge infrared rays onto the infrared detector element.

It is a still further object of the present invention to provide an electronic oven in which the infrared detector element and the infrared converging means are disposed above the mounting wall, and the air which has passed in the vicinity of the infrared detector element and the infrared converging means, is conveyed into the cavity from the opening formed in the mounting wall, thereby to prevent the infrared detector element from being heated to extremely high temperatures so as to improve the reliability, as well as to prevent the infrared detector element and the infrared converging means from being contaminated by a pollutant in the cavity.

It is a still further object of the present invention to provide an electronic oven in which a microwave stirrer to be rotated by an air current is disposed under the mounting wall, and a dielectric protection cover is disposed under this stirrer, thereby to prevent contamination of the stirrer.

It is a still further object of the present invention to provide an electronic oven in which a ring permitting infrared rays to pass therethrough and intercepting microwaves is attached at the opening in the mounting wall, and the stirrer is mounted to this ring so as to be rotatable about the ring, whereby the stirrer mounting mechanism is simplified.

It is a still further object of the present invention to provide an electronic oven in which an opening having a diameter substantially equal to that of the opening of the microwave-intercepting ring, is formed in the protection cover and is closely connected to the lower opening of the ring, thereby to prevent sticking of a pollutant to the rotary bearing of the stirrer, whereby a smooth rotation of the stirrer may be secured.

It is a still further object of the present invention to provide an electronic oven in which a chopper for converting infrared rays into heat pulses is disposed between the infrared converging means and the microwave intercepting ring, thereby to efficiently perform the temperature measurement operation in which infrared rays are utilized.

BRIEF DESCRIPTION OF THE DRAWINGS

The invention will be further described by way of example, with reference to the accompanying drawings, in which.

DETAILED DESCRIPTION OF THE PREFERRED EMBODIMENTS

Figure 1:
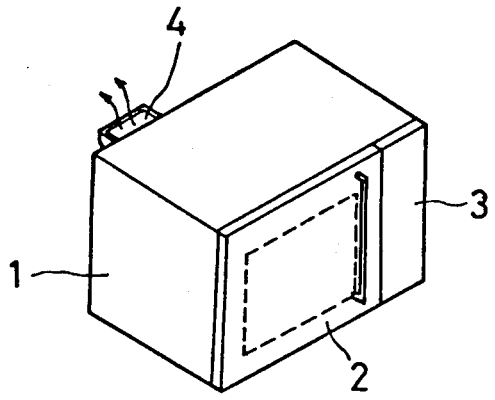
FIG. 1 is a general perspective view of an electronic oven in accordance with the present invention.

First of all, a description will be made with reference to FIG. 1 showing a general perspective view of an electronic oven to which the present invention is applied.

In FIG. 1, an electronic oven includes a main body 1, a door 2, an operation panel 3 for controlling the microwave output or the like, and an exhaust port 4 for exhausting the atmosphere in the cavity in the main body 1.

The description hereinbelow will discuss the first embodiment of the present invention, with reference to FIGS. 2 and 3.

A cavity 5 is formed in the electronic oven main body 1 and is defined by an upper wall 6, in which an opening 7 is formed at the center thereof, and bottom and side walls. A ring 8 is hung down from and mounted to the upper wall 6 around an opening 7 and permits infrared rays radiated from food heated in the cavity 5, to pass therethrough as well as to intercept microwaves. This ring 8 may be formed as having, for example, an inner diameter of about 16 mm and a depth of about 20 mm, and intercepts microwaves of 2450 MHz.

A stirrer 9 for stirring microwaves is adapted to be rotated around the ring 8 by the currents within the cavity. A circular guide plate 10 is securely fixed to the cavity upper wall 6 for guiding the air so as to smooth the rotation of the stirrer 9.

A dielectric protection cover 11 is inserted with supports on the side wall 12 of the cavity 5 being guides, and is located under the stirrer 9 for protecting the stirrer 9 from the atmosphere containing a pollutant such as oil drops and vapor derived from heated food.

An opening 13 is formed in the protection cover 11 at the portion thereof which is just below the ring 8. Also mounted on a side wall 12 are a magnetron 14 for supplying microwaves into the cavity 5 and a blower 15 for supplying air, which, after cooling the magnetron 14, passes through a plurality of bores (not shown) in the side wall 12 of the cavity 5 and through the clearance between the upper wall 6 and the protection cover 11 to rotate the stirrer 9, and then enters into the lower part of the cavity 5 from the opening 13 in the protection cover 11.

A mounting wall 16 is disposed above the upper wall 6, and a chopper 17 formed of a metallic porous disc is disposed above the ring 8. This chopper 17 is rotated by a motor 18 disposed on the mounting wall 16 and periodically converts infrared rays passing through the ring 8, into heat pulses.

An opening 19 is formed in the mounting wall 16 at the portion thereof which is just above the ring 8. A reflective convergent surface 20 in the shape of a concave mirror as provided as an infrared converging means and for reflecting and converging infrared rays. Reflector 20 is disposed above the opening 19 formed in the mounting wall 16 and under a supporting plate 21. A supporting shaft 22 is disposed as a supporting means for movably supporting the supporting plate 21, which is adapted to be rotated around the supporting shaft 22. Disposed on the mounting wall 16 is an electromagnet 23 for moving the infrared converging means, and a metallic cable 25 is disposed between the movable portion 24 of the electromagnet 23 and the upper end of the supporting plate 21. Pulleys 26 are disposed for guiding the cable 25.

A stop 27 is securely fixed onto the mounting wall 16. When the supporting plate 21 is rotated around the supporting shaft 22 under the action of the electromagnet 23, the lower end of the supporting plate 21 comes in contact with the stop 27, so that the rotary movement of the supporting plate 21 is limited to a predetermined position.

An infrared detector element 28 converts infrared rays into electrical signals and may be made of a crystal of lithium tantalic oxide ($LiTaO_3$). This infrared detector element 28 is located in the vicinity of the point where infrared rays are converged by the reflective convergent surface 20 when the supporting plate 21 is in contact with the stop 27. This infrared detector element 28 has a pyroelectric effect of producing electric charges when temperature differences take place on its surface.

A mounting plate 29 is vertically disposed on wall 16 for mounting the infrared detector element 28. A metallic case 30 for housing the infrared detector element 28 or other electric parts is securely fixed onto the mounting wall 16 and blocks inward-penetration of leakage microwaves from detector 28.

An infrared entrance port 32 is formed in a contact plate 31 which is the front surface of the case 30. The diameter of this infrared entrance port 32 is made small to permit infrared rays passing to the infrared detector element 28, to pass through this entrance port 32. This infrared entrance port 32 is adapted to be covered and closed by the reflective convergent surface 20 when the supporting plate 21 comes in contact with the contact plate 31.

The description is now made of the operation of the first embodiment.

When the temperature measurement operation is performed, the electromagnet 23 is driven to rotatably move the supporting plate 21 clockwise through the cable 25 until it comes in contact with the stop 27, so that infrared rays radiated from heated food are reflected and converged by the reflective convergent surface 20 to be detected by the infrared detector element 28.

On the other hand, when the temperature measurement operation is not performed, the plunger of electromagnet 23 extends and the supporting plate 21 moves counterclockwise away from the stop 27 by its own weight or aided by a spring. The periphery of the reflective convergent surface 20 comes then in contact with the contact plate 31 of the case 30 in which the infrared entrance port 32 is formed, so that this infrared entrance port 32 is closed.

Accordingly, when the temperature measurement operation is not performed, the infrared converging means contacts with the contact plate 31. This means that the infrared entrance port 32 is covered and simultaneously with that the reflective convergent surface 20 is covered by the contact plate 31. The reflective convergent surface 20 of the infrared converging means and the infrared detector element 28 are therefore not contaminated, even though an atmosphere containing a pollutant such as vapor and oil drops or others derived from food heated in the cavity 5, passes through the opening 7 formed in the upper wall 6 of the cavity 5.

It is to be noted that, since the movement of the infrared converging means is rotatably made, such operation is made by a small force with little friction.

Furthermore, there is provided a distance between the lower end of the contact plate 31 and the periphery of the opening 19 in the mounting wall 16, thereby to eliminate, when the temperature measurement operation is not performed, such a trouble that a pollutant can attach to the periphery of the reflective convergent surface 20 and the front surface of the contact plate 31, which subsequently become sticky and are then separated from each other with difficulty.

Moreover, when the temperature measurement operation is performed, the air supplied from the plurality of bores in the side wall 12 of the cavity 5 to the clearance between the upper wall 16 and the protection cover 11, is then conveyed from the opening 13 in the protection cover 11 into the cavity 5, thereby to prevent a pollutant from upwardly entering into the space above the cavity 5, so that the infrared detector element 28 and the reflective convergent surface 20 are kept away from contamination by the pollutant.

In an electronic oven of this kind, a temperature operation and a timer operation are to be performed, but the temperature measurement of food to be heated is performed in the temperature operation mode and is not performed in the timer operation mode.

The description hereinbelow will discuss the second embodiment shown in FIG. 4.

Figure 2:
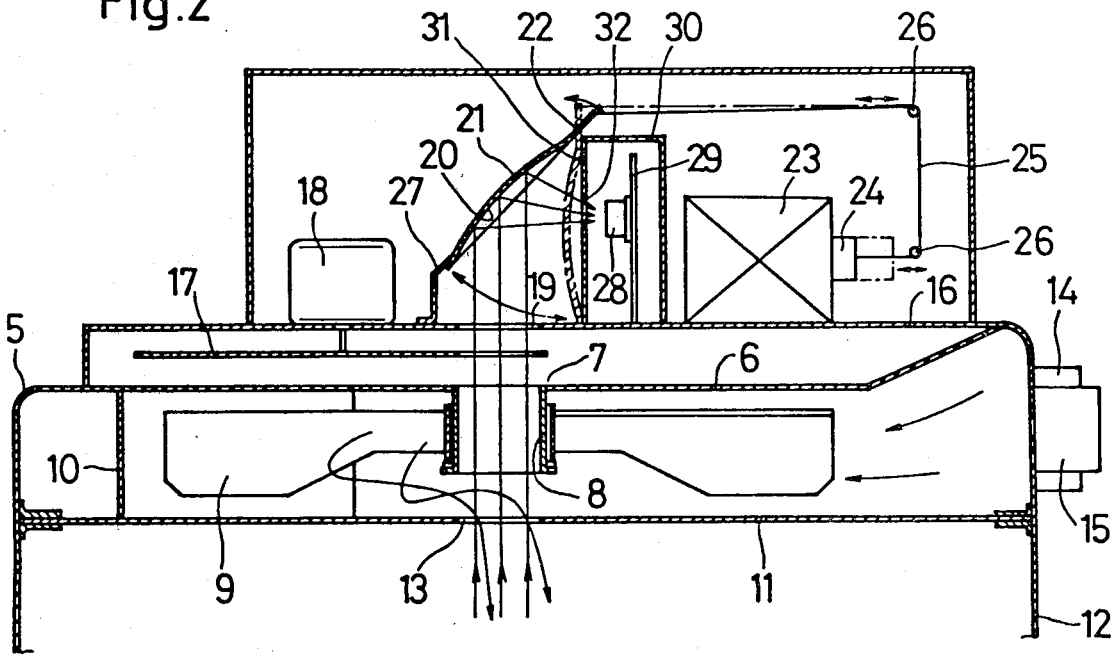
FIG. 2 is a sectional view of the oven in accordance with main portions of a first embodiment of the present invention.
Figure 3:
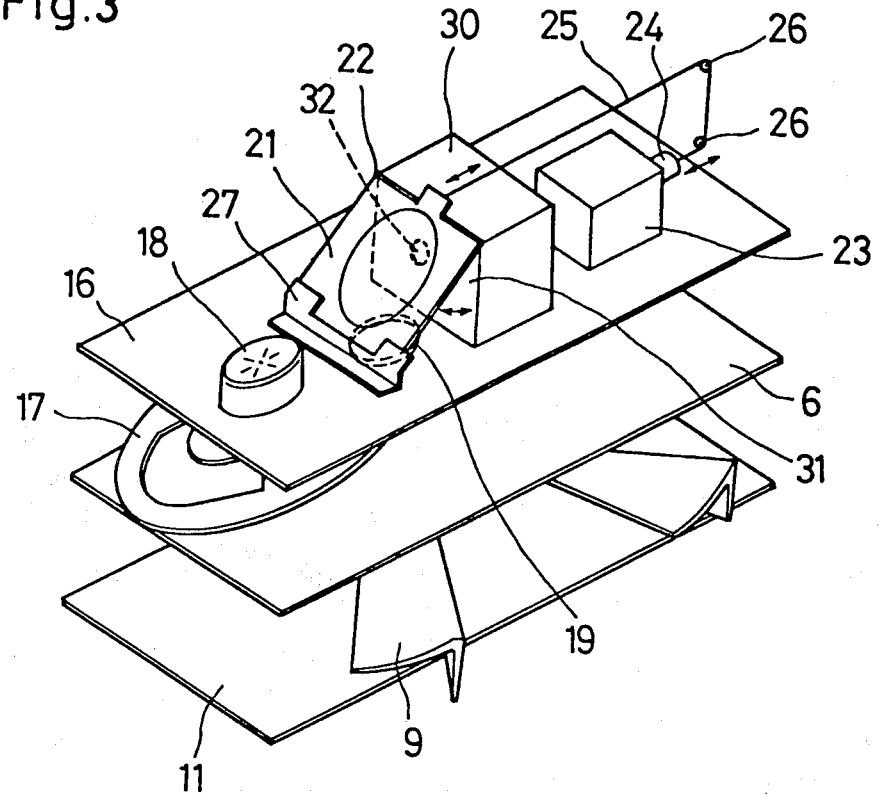
FIG. 3 is a perspective view of main portions of the embodiment of FIG. 2.
Figure 4:
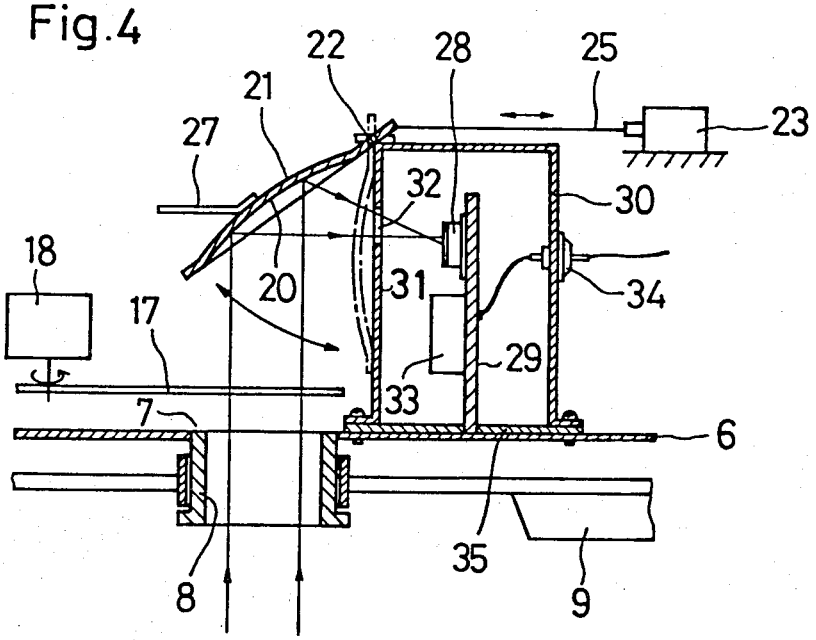
FIG. 4 is a sectional view of main portions of a second embodiment.

The differences between the first embodiment shown in FIG. 2 and the second embodiment shown in FIG. 4 reside in that, in the second embodiment, the upper wall 6 of the cavity 5 serves also as the mounting wall 16 in FIG. 2, and the chopper 17 is disposed just above the opening 7 formed in the upper wall 6. Further, electric parts 33 including a pre-amplifier are mounted onto a mounting plate 29 of the infrared detector element 28, and a feed through capacitor 34 is attached to the case 30. A conductor 35, such as an aluminium foil is disposed between the case 30 and the upper wall 6, to prevent leakage microwaves from entering into the case 30 so as to prevent noise from mixing with a detection signal from the infrared detector element 28.

In FIG. 4, like parts are designated by like numerals in FIG. 2.

Figure 5:
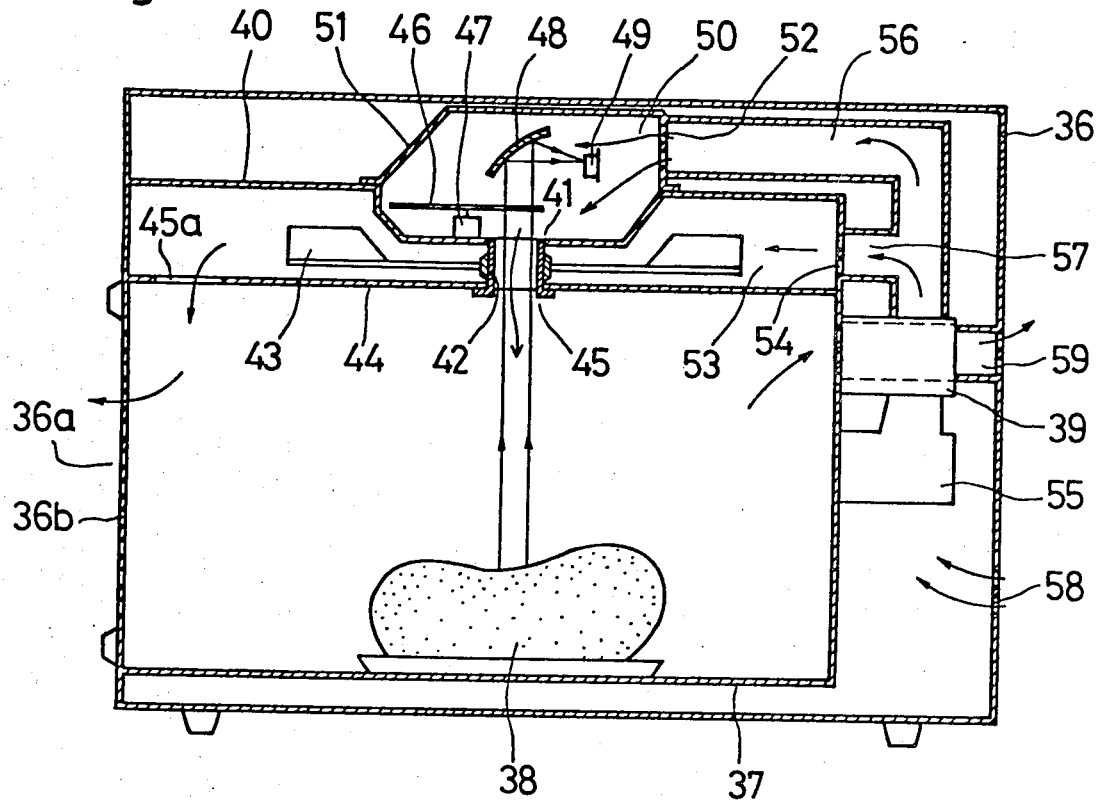
FIG. 5 is a sectional view of main portions of a third embodiment.

The description hereinbelow will discuss the third embodiment of the present invention which is shown in FIG. 5.

A cavity 37 is formed in an electronic oven main body 36. Food heated 38 is to be placed in the cavity 37. A magnetron 39 is disposed for providing microwaves for heating the food 38. An opening 41 is centrally formed in the upper wall 40 of the cavity 37. A microwave prevention ring 42 is inserted into the opening 41. This ring 42 permits infrared rays radiated from heated food 38 to pass therethrough, but intercepts the microwaves reflected from cavity. A stirrer for stirring microwaves 43 is pivoted to the ring 42 and is adapted to be rotated around the ring 42.

A dielectric protection cover 44 partitions the stirrer 43 from the food to be heated 38, and an opening 45 is formed in this protection cover 44 at the portion thereof which is just below the opening 41 in the upper wall 40, the opening 45 having a dimension substantially identical to that of the opening 41.

A chopper 46 is periodically driven by a motor 47 and periodically interrupts infrared rays which pass through the ring 42 which extends into the opening 41 in the upper wall 40 and the opening 45 in the protection cover 44. A reflective convergent surface 48 comprises a concave mirror as an infrared converging means and is adapted to reflect and converge infrared rays from the heated food 38 which have been periodically interrupted by the chopper 46.

An infrared detector element 49 for detecting infrared rays is located about at a point to which infrared rays are converged by the reflective convergent surface 48, and measures the temperature of the food being heated 38.

A first air passage 50 is defined in such a way as to cover the infrared detector element 49 by a cover plate 51 and the upper wall 40 adjacent to the opening 41. This first air passage 50 is formed from an inlet port by a plurality of small bores 52 in the cover plate 51, to an outlet port former by the opening 45 in the protection cover 44 through which the ring 42 passes.

A second air passage 53 is defined in such a way as to include in its path the stirrer 43. The second passage is formed by the protection cover 44 and the upper wall 40 of the cavity 37 to rotate the stirrer 43. This second air passage 53 is formed from an inlet port including a plurality of small bores 54 and an outlet port including by an opening 45*a* defined in the periphery of the protection cover 44.

A blower 55 is disposed for supplying air, which is sent, after cooling the magnetron 39, to the first and second air passages 50 and 53 through branched coupling pipes 56 and 57. A plurality of small bores 58 are formed in the lateral side of the main body 36 so that in air from blower 55 sucks the outside of the oven.

An exhaust duct 59 is disposed at the coupling pipes 56, 57 for exhausting vapor and oil drops, etc. contained inside the cavity 37. Such vapor and oil drops, etc. contained inside the cavity 37 are also exhausted through bores 36*b* in the door 36*a* of the cavity 37.

In such a construction, when intending to perform, for example, a temperature operation such that a high frequency heating operation is stopped when the temperature of food to be heated 38 reaches 80° C., the magnetron 39 first starts oscillating and the infrared detector element 49 starts detecting infrared rays radiated from the heated food 38 for measuring the temperature of the heated food 38. The blower 55 also starts supplying air, which is then sent, after cooling the magnetron 39, to the first air passage 50 and the second air passage 53 through the branched coupling pipes 56 and 57, respectively.

The air in the first air passage 50 cools the infrared detector element 49 while the air reached the second air passage 53 rotates the stirrer 43. The air in the first and second air passages 50 and 53 is then sent toward the lower part of the cavity 37 through the openings 45 and 45*a* in the protection cover 44, respectively, and is finally exhausted, together with vapor and oil drops, etc. in the cavity 37, from the exhaust duct 59 and the bores 36*b* in the door 36*a*.

Thereafter, when the temperature of the heated food 38 is measured as 80° C. by the infrared detector element 49, the high frequency heating operation is stopped, simultaneously stopping the temperature measurement by the infrared detector element 49 and the air supply from the blower 55, thus completing the temperature operation.

Accordingly, at least in the case of the temperature operation mode, the air which has cooled the infrared detector element 49, and the air which has rotated the stirrer 43, are both conveyed toward the lower part of the cavity 37 through the openings 45 and 45*a* in the protection cover 44, respectively, thereby to prevent in a very efficient manner vapor and oil drops, etc. in the cavity 37 from upwardly passing through the ring 42 and appearing in the opening 41 in the upper wall 40 in the cavity 37 and the opening 45 in the protection cover 44.

Although one blower 55 supplies air to the first and second air passages 50 and 53 in this third embodiment, it is a matter of course that a respective blower means may be disposed for each of the passages. In such an arrangement the air flow is made greater toward the lower part of the cavity 37 through the openings 45 and 45*a* in the protection cover 44.

It is to be noted that, although this embodiment has been described only in connection with the temperature operation mode, this embodiment may also be applied to an electronic oven in which other operation modes including a timer operation are also to be performed.

Figure 6:
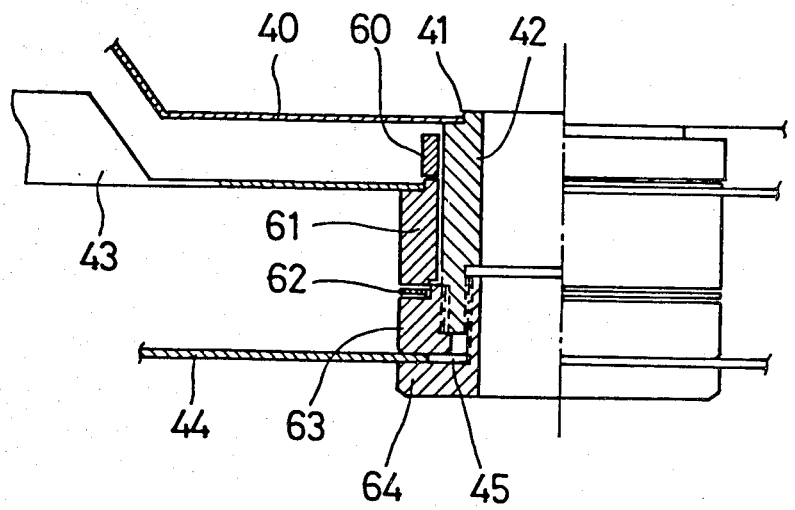
FIG. 6 is an enlarged section view of main portions of the embodiment of FIG. 5.

A description is now made by referring to FIG. 6 showing main portions of the embodiment of FIG. 5 in an enlarged scale.

An annular spacer 60 is fitted onto the ring 42 which is inserted into the opening 41 in the upper wall 40 of the cavity 37. A boss 61 of the stirrer 43 is inserted onto the ring 42 below the spacer 60. A washer 62 is inserted onto the ring 42 below the boss 61 and is made of synthetic resin having a small frictional coefficiency such as tetrafluoroethylene.

A nut 63 is threadedly connected to the outside of the lower portion of the ring 42 below the washer 62, and an open bolt 64 is inserted to the opening 45 in the protection cover 44 and is threadedly connected to the inside of the lower portion of the ring 42. The protection cover 44 is inserted between the nut 63 and the bolt 64, so that the clearance between the ring 42 and the opening 45 in the protection cover 44 is filled. The spacer 60, the boss 61 of the stirrer 43, the nut 63 and the open bolt 64 are made of synthetic resin such as polypropylene.

In such an arrangement, vapor and oil drops derived from the heated food do therefore not stick to the rotary bearing of the air-driven stirrer 43, because the opening 45 in the protection cover 44 is covered by the open bolt 64. This completely eliminates troubles caused by sticking of oil drips, etc., which would cause the stirrer 43 to rotate in an uneven manner or stop rotating so as to heat unevenly the food to be heated, thereby to permit no accurate temperature measurement.

Figure 7:
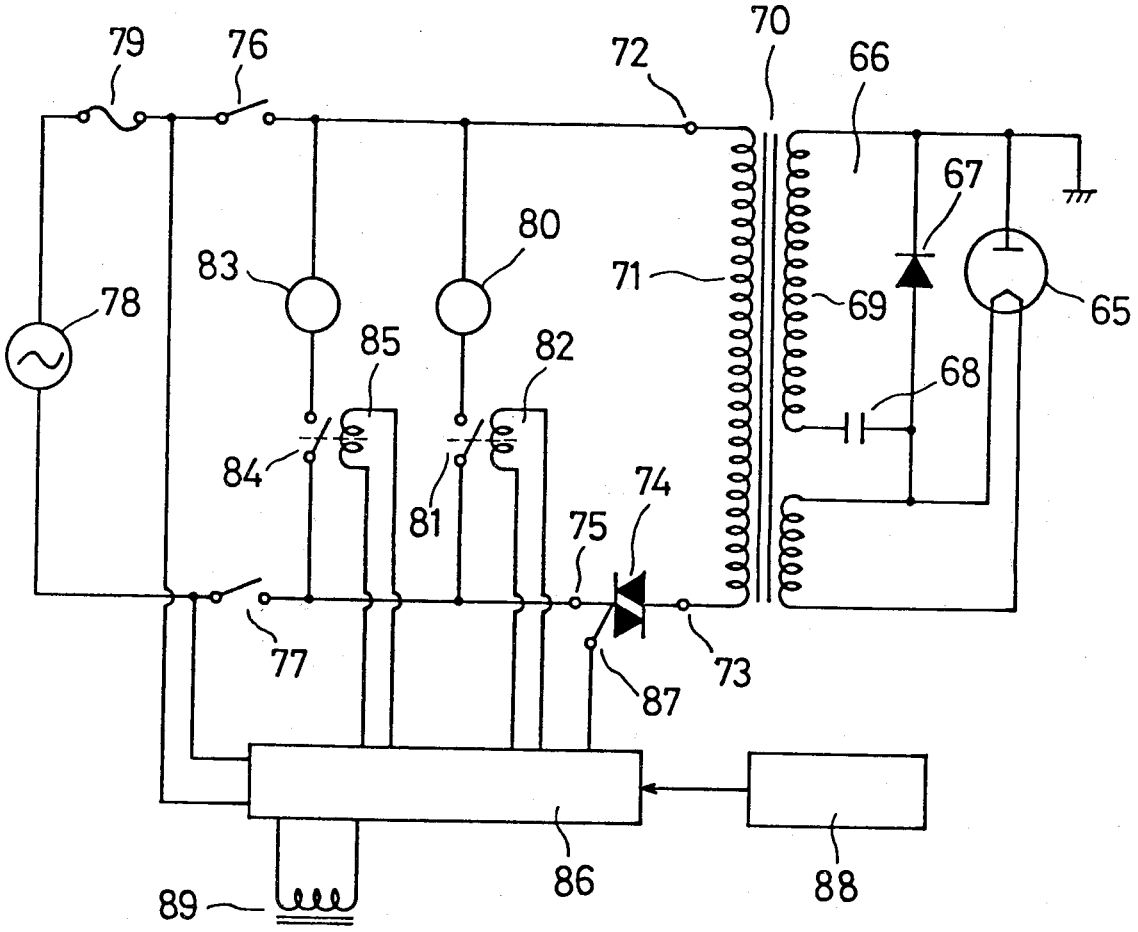
FIG. 7 is an example of an electric circuit diagram used in an electronic oven of the present invention.

A description is now made of an example of an electric circuit diagram used in the present invention, by referring to FIG. 7.

A magnetron 65 is disposed for oscillating microwaves for heating food to be heated. A half-wave voltage doubler rectification circuit 66 comprises a high voltage diode 67 and a high voltage condenser 68.

The secondary winding 69 of a leakage transformer 70 is disposed for supplying electric power to the magnetron 65 through the rectification circuit 66. The primary winding 71 of the transformer 70 has one terminal 72 and a second terminal 73. A semi-conductor control element 74 comprises a Triac having one terminal connected to the second terminal 73, and controls the oscillation output of the magnetron 65. The Triac 74 has a second terminal 75. Door switches 76 and 77 responsive to the opening and closing of the door. An alternating current power supply 78 has one terminal connected to the terminal 72 of the transformer primary through a power supply fuse 79 and one door switch 76, and the other terminal connected to the terminal 75 through the other door switch 77.

A blower motor 80 is disposed for cooling the magnetron 65 and a blower motor switch 81 is adapted to be turned ON by an electromagnet relay 82. The blower motor 80 and the blower motor switch 81 are connected to each other in series, and this series circuit is connected to the terminals 72 and 75.

A chopper motor 83 is connected in series to a chopper motor switch 84 adapted to be turned ON by an electromagnet relay 85. This series circuit is also connected to the terminals 72 and 75.

A control circuit 86 is connected to both terminals of the alternating current power supply 78 through the power supply fuse 79.

By the operation of a cooking switch or others disposed on the front operation panel of the electronic oven main body, this control circuit 86 is adapted to produce a control signal, thereby to control a gate terminal 87 of the semi-conductor control element 74 and the electromagnetic relays 82 and 85.

An infrared detection circuit 88 is operable by a detection signal from the infrared detector element, and turns OFF the control circuit 86. A solenoid 89 actuates the electromagnet 23 in FIG. 2, 3 or 4 and is operable simultaneously with the operation of the electromagnet 85 by the control circuit 86.

In the temperature operation mode, when food to be heated is placed in the electronic oven main body and the door is closed, the door switches 76 and 77 are closed. Thereafter, when the cooking switch is operated, the control circuit 86 detects such operation and gives to the gate terminal 87 a control signal to cause the semi-conductor control element 74 to be conductive. The magnetron 65 therefore starts producing microwaves for heating the food, because electric power is supplied from the transformer 70. Since the control circuit 86 gives simultaneously control signals to the electromagnetic relays 82 and 85 and the solenoid 89, the blower motor switch 81 and the chopper motor switch 84 are closed, so that the blower motor 80 and the chopper motor 83 starts operating, and the electromagnet 23 also starts operating. Accordingly, at the same time the magnetron 65 starts oscillating, the blower motor 80 starts cooling the magnetron 65 and the infrared converging means is located at a predetermined position by the operation of the electromagnet 23 and infrared rays to the infrared converging means are periodically converted into heat pulses by the operation of the chopper motor 83.

When the food to be heated reaches a predetermined temperature and the infrared detector element detects such predetermined temperature to operate the infrared detection circuit 88, the control circuit 86 is turned OFF and no control signals are therefore applied to the gate terminal 87 of the semi-conductor control element 74, the electromagnetic relays 82 and 85 and the solenoid 89. The magnetron 65 subsequently stops oscillating, and the blower motor 80 and the chopper motor 83 also stop operating, and the infrared converging means is then returned to the original position.

In the timer operation mode, the control circuit 86 does not give control signals to the electromagnetic relay 85 and the solenoid 89, and the chopper motor 83 and the electromagnet 23 are therefore not operated. After a predetermined period of time has passed, the control circuit 86 is turned OFF and no control signals are therefore given to the electromagnetic relay 82 and the semi-conductor control element 74, so that the magnetron 65 stops oscillating and the blower motor 80 also stops operating.

What is claimed is:

1. An electronic oven comprising:

a cavity, an infrared converging means having a reflective convergent surface and adapted to reflect and converge infrared rays radiated from food heated in said cavity, a supporting means for movably supporting said infrared converging means, an infrared detector element located in the vicinity of the point where infrared rays are converged by said infrared converging means, and adapted to convert the infrared rays into electrical signals, a plate disposed in front of said infrared detector element, an infrared entrance port being formed in said plate which said reflective convergent surface of said infrared converging means is adapted to cover, and a moving means for moving said infrared converging means to a first position as to reflect and converge infrared rays onto said infrared detector element when the temperature measurement operation is performed, and to a second position as to close said infrared entrace port when the temperature measurement operation is not performed.

2. An electronic oven comprising:

a cavity, an infrared converging means having a reflective convergent surface and adapted to reflect and converge infrared rays radiated from food heated in said cavity, a supporting means for movably supporting said infrared converging means, an infrared detector element located in the vicinity of the point where infrared rays are converged by said infrared converging means, and adapted to convert infrared rays into electrical signals, a case for housing said infrared detector element and provided at the front thereof with a plate in which an infrared entrance port is formed and with which said infrared converging means is adapted to come in contact, and a moving means for moving said infrared converging means to a first position as to reflect and converge infrared rays onto said infrared detector element when the temperature measurement operation is performed, and to a second position as to come in contact with said plate to close said infrared entrance port when the temperature measurement operation is not performed.

3. An electronic oven as set forth in claim 1 or 2, wherein said supporting means comprises a supporting shaft for rotatably supporting said infrared converging means, so that, when said moving means of said infrared converging means is not operated, said infrared converging means is rotated by the weight thereof or a spring to close said infrared entrance port in said plate.

4. An electronic oven as set forth in claim 1 or 2, wherein said plate is attached to a mounting wall having therein an opening through which infrared rays pass, and a space is provided between the lower end of said contact plate and the periphery of said opening.

5. An electronic oven as set forth in claim 3, wherein said infrared converging means has a supporting plate to which a concave mirror is attached, the upper portion of said supporting plate being rotatably supported by said supporting shaft.

6. An electronic oven as set forth in claim 1 or 2 wherein said moving means of said infrared converging means comprises an electromagnet, and means for connecting the moveable portion of said electromagnet to said infrared converging means.

7. An electronic oven as set forth in claim 6, further comprising a stop adapted to locate said infrared converging means to such a position as to reflect and converge infrared rays onto said infrared detector element when said moving means of said infrared converging means is operated.

8. An electronic oven as set forth in claim 1 or 2, wherein said infrared converging means, said infrared detector element and said plate are disposed above a mounting wall having therein an opening through which infrared rays pass, and air is sent into said cavity from the space above said mounting wall through said opening in said mounting wall.

9. An electronic oven as set forth in claim 8, further comprising a microwave stirrer to be air-rotated disposed under said mounting wall, and a dielectric protection cover disposed under said stirrer.

10. An electronic oven as set forth in claim 9, further comprising a ring permitting infrared rays to pass therethrough and intercepting microwaves attached at the opening in said mounting wall, and said microwave stirrer being attached to said ring to be rotatable about said ring.

11. An electronic oven as set forth in claim 10, wherein an opening having a diameter substantially equal to that of the opening of said microwave-intercepting ring, is formed in said dielectric protection cover, said opening in said dielectric protection cover being closely connected to said lower opening in said ring.

12. An electronic oven as set forth in claim 10, wherein air which has passed through the space above said mounting wall, is sent into said cavity through said opening in said mounting wall, said ring and said opening in said dielectric protection cover.

13. An electronic oven as set forth in claim 10, further comprising a chopper for periodically converting infrared rays into heat pulses disposed between said infrared converging means and said ring for intercepting microwaves.

14. An electronic oven as set forth in claim 1 or 2, further comprising;

an opening formed in the upper wall of said cavity under said infrared converging means, a ring attached to said opening, said ring permitting infrared rays to pass therethrough and intercepting microwaves, a dielectric protection cover having therein an opening just below said ring, a microwave stirrer to be wind-rotated disposed between said upper wall and said dielectric protection cover, a magnetron for supplying microwaves into said cavity, and a chopper disposed between said ring and said infrared converging means for periodically converting infrared rays into heat pulses, which are subsequently projected to said infrared converging means.

15. An electronic oven as set forth in claim 5 wherein said moving means of said infrared converging means comprises an electromagnet and means for connecting the moveable portion of said electromagnet to the upper end of said supporting plate for said infrared converging means.

16. An electronic oven as set forth in claim 15, further comprising a stop adapted to locate said infrared converging means to such a position as to reflect and converge infrared rays onto said infrared detector element when said moving means of said infrared converging means is operated.

* * * * *